US012539997B1

(12) United States Patent
Babarinsa et al.

(10) Patent No.: US 12,539,997 B1
(45) Date of Patent: Feb. 3, 2026

(54) RECEPTACLE-EXPANDING APPARATUS FOR SORTATION WALL

(71) Applicant: Amazon Technologies, Inc., Seattle, WA (US)

(72) Inventors: Samuel Olukayode Babarinsa, Seattle, WA (US); Aishwarya Srinivasan, Seattle, WA (US); Rehan Irfan, Seattle, WA (US); James Mendoza, Kent, WA (US); Scott D King, Sammamish, WA (US); William G Bowes, Kirkland, WA (US)

(73) Assignee: Amazon Technologies, Inc., Seattle, WA (US)

( * ) Notice: Subject to any disclaimer, the term of this patent is extended or adjusted under 35 U.S.C. 154(b) by 118 days.

(21) Appl. No.: 18/620,795

(22) Filed: Mar. 28, 2024

(51) Int. Cl.
*B65B 43/46* (2006.01)

(52) U.S. Cl.
CPC ..... *B65B 43/465* (2013.01)

(58) Field of Classification Search
CPC ..... B65B 43/42; B65B 43/46; B65B 43/465
See application file for complete search history.

(56) References Cited

U.S. PATENT DOCUMENTS 2,540,489 A * 2/1951 Pretzer ..... B65B 25/04 271/99
3,155,183 A * 11/1964 Bradford ..... G01G 13/16 221/296
3,540,497 A * 11/1970 Troyer ..... B65B 43/54 248/101
5,001,889 A * 3/1991 Mueller ..... B65B 39/10 53/502
5,331,792 A * 7/1994 Kitchen ..... B65B 37/005 53/259
5,555,709 A * 9/1996 Savigny ..... B65B 43/60 53/247
7,025,097 B1 * 4/2006 Hayes ..... B65B 43/30 141/10
7,856,792 B2 * 12/2010 Koga ..... B65B 57/145 53/493
11,535,450 B1 * 12/2022 Kalm ..... B65G 47/252
11,939,164 B1 * 3/2024 Robb ..... B25J 9/0093
2014/0250834 A1 * 9/2014 Yoshikane ..... B65B 51/146 141/4

* cited by examiner

*Primary Examiner* — Nicolas A Arnett
(74) *Attorney, Agent, or Firm* — Kilpatrick Townsend & Stockton LLP

(57) ABSTRACT

A loading apparatus may include a chute passageway, a gate, and a splitter. The chute passageway may include a chute surface positioned extending along at least a portion of a distance between an inlet opening of the chute and an outlet opening of the chute passageway. The gate may be moveable between a closed position obstructing passage through the outlet opening and an open position permitting passage through the outlet opening. The splitter may be mechanically coupled with the gate by a linkage configured to convert movement of the gate toward the closed position into movement of the splitter toward an away position so as to split a traveling wall of a receptacle away from a base wall of the receptacle when the receptacle is received with the base wall along the chute surface.

20 Claims, 9 Drawing Sheets

RECEPTACLE-EXPANDING APPARATUS FOR SORTATION WALL

BACKGROUND

Inventory systems, such as those in warehouses, supply chain distribution centers, airport luggage systems, and custom-order manufacturing facilities, face significant challenges in transporting inventory items. As inventory systems grow, the challenges of simultaneously completing a large number of tasks such as packing, storing, picking, staging, and other inventory-related tasks become non-trivial.

In inventory systems tasked with responding to large numbers of diverse inventory requests, inefficient utilization of system resources, including space, equipment, and manpower, can result in lower throughput, unacceptably long response times, an ever-increasing backlog of unfinished tasks, and, in general, poor system performance. Additionally, expanding or reducing the size or capabilities of many inventory systems may require significant changes to existing infrastructure and equipment. As a result, the cost of incremental changes to capacity or functionality may be prohibitively expensive, limiting the ability of the system to accommodate fluctuations in system throughput.

BRIEF DESCRIPTION OF THE DRAWINGS

Various embodiments in accordance with the present disclosure will be described with reference to the drawings, in which.

DETAILED DESCRIPTION

Figure 1:
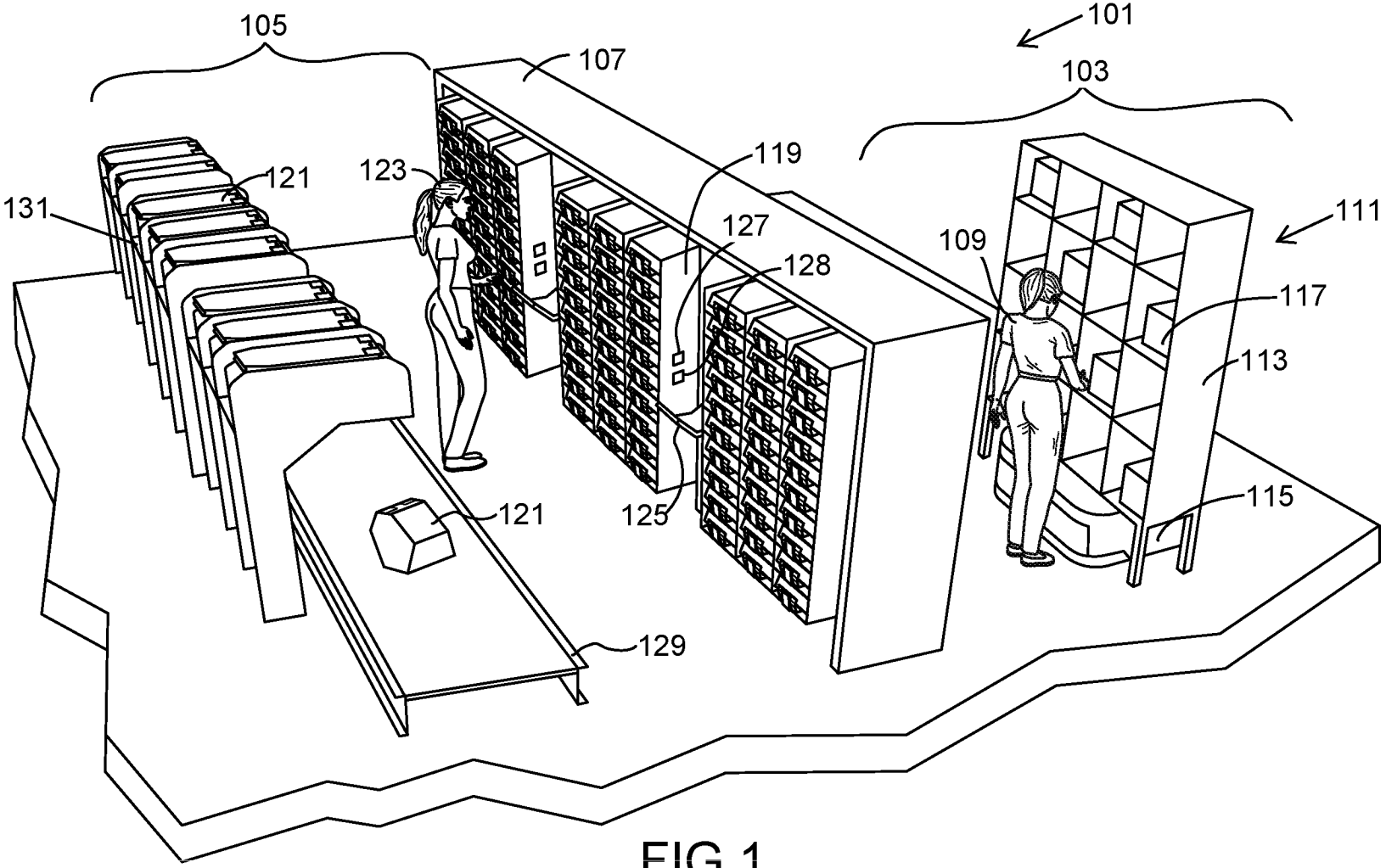
FIG. 1 illustrates a system with a sortation wall between stations in accordance with various embodiments.

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

Embodiments herein may relate to inventory management systems, such as may be used in order fulfillment centers or other warehouse environments. Structures may include mechanisms that may facilitate loading of bags or other receptacles into a sortation wall in efficient manners for operators engaged in related operations.

In various examples, a sortation wall may be positioned between two different stations. On one side, an item-aggregation station may be positioned. On the other side, a packaging-processing station may be positioned. The sortation wall may have pass-through passageways that items can be transferred into and through for operations at the different stations. At the item-aggregation station, items (e.g., corresponding to a particular set of items specified in an order to be fulfilled) may be collected and placed into a particular passageway, which may aggregate the items together in a receptacle in the passageway. When a complete set has been aggregated, an operator at the packaging-processing station on the opposite side may remove the receptacle with the aggregated items and perform operations for finalizing packaging of the order containing those items. Overall, different orders may be sorted into different passageways, and aggregated items in a particular passageway may be processed on the packaging-processing side upon completion of collection of all items on the item-aggregation side for the order in the respective passageway.

The sortation wall within respective passageways may include structure that can facilitate efficient and/or rapid implementation of sorting directly into shippable receptacles in use. The shippable receptacles may correspond to paper bags or other forms of collapsible containers and may include suitable cushioning and/or other materials. In some examples, walls of the shippable receptacle may include or be supplemented with cardboard, corrugate, or other suitable materials. Use of collapsible containers may allow receptacles to be provided in a compact form for storage and initial insertion into a passageway, and an act of closing a gate of the passageway may operate to expand the receptacle into a suitable configuration for receiving and containing items.

In an illustrative implementation, an operator on a packaging-processing side of the wall may pull open a gate of a particular passageway, insert a collapsed receptacle into the passageway, and close the gate behind the receptacle. The gate may be mechanically coupled by a linkage to other components that may move in response to closing of the gate. For example, a retention clip may start out pivoted upward to allow a tab at the leading end of the collapsed receptacle to be slid underneath the retention clip when the gate is open, and the retention clip may be moved to a clamped or engaged position in response to closing of the gate, such as based on movement of linkages and/or other components that convert or transfer movement between the gate and the retention clip. The retention clip may retain a base wall of the receptacle, for example. A splitter apparatus may be included in the passageway and may be coupled with the linkage. In response to closing of the gate, the linkage can move a plate or other member of the splitter upward to catch a handle on the receptacle and pull a traveling wall of the receptacle away from the receptacle's base wall (which may be retained in place by the retention clip). In this manner, closing the gate may cause the base wall of the receptacle to be clamped into position and may further cause a splitter to move the traveling wall away from the retained base wall so that the receptacle is expanded from a collapsed configuration to an expanded configuration.

With the receptacle in the expanded configuration, an open end of the receptacle may be pointed toward or facing toward the item-aggregation station, which may provide an open face of the receptacle through which an operator at the item-aggregation station can insert items for that receptacle, such as for in order to be included in that receptacle. Upon receiving all of the items designated for an order or that receptacle, the operator on the packaging-processing station side may open the gate to remove the now-full or loaded receptacle.

Opening the gate may move components to facilitate ease of removing the completed receptacle. For example, opening the gate may move the linkage in a manner that will cause the splitter to move away from the traveling wall of the receptacle. The receptacle may remain in the expanded configuration based on the items holding the receptacle in the expanded configuration even when the splitter has been removed from holding the receptacle in the expanded configuration, for example. The act of opening the gate may additionally or alternatively activate or release the retainer. For example, during movement of the splitter, a bar or other part of the splitter may engage a groove or other part of the retainer so that the retainer will pivot and release the portion of the base wall of the receptacle that was previously retained by the retainer. With the splitter and retainer both disengaged from the receptacle by motion imparted by the act of opening the gate, the operator on the packaging-processing station side may extract the completed receptacle through the open gate.

The packaging-processing station may facilitate other operations with the completed receptacle, such as recognizing items within the receptacle (such as by cameras, scanners, or other components suitable for recognizing items, detecting whether an intended item combination is within the receptacle, and/or identifying an arrangement of items within the receptacle), adjusting positioning of items within the receptacle, removing items, and/or adding to the receptacle with packaging, cushioning, labels, manifests, missing items, or other supplemental material. The receptacle may be closed with appropriate contents inside and then output on a conveyor or other structure from the packaging-processing station. With the gate open (such as from extracting one completed receptacle or opened for another loading round), an operator at the packaging-processing station may introduce another receptacle and close the gate to effectively reload the passageway with a suitable receptacle for the operator at the item aggregating station on the other side of the sortation wall to utilize as another location for collecting items for another order.

Referring now to the figures, FIG. 1 illustrates a system 101 according to various embodiments. The system 101 can correspond to an inventory management system or other system with suitable components for use in a warehouse, order fulfillment center, or other context. The system 101 is depicted as including a first station (e.g., an item-aggregation station 103), a second station (e.g., a packaging-processing station 105), and a sortation wall 107, although more, fewer, or other elements may additionally or alternatively be included. The sortation wall 107 may be positioned between the item-aggregation station 103 and the packaging-processing station 105.

The item-aggregation station 103 may be configured as a first operating environment for a first operator 109. The item-aggregation station 103 may include a suitable item conveyance or item input system 111. The item input system 111 is shown having a rack 113 that may be conveyed by a mobile drive unit 115 among different locations within a workspace, although any suitable set of conveyors, conveyor belts, chutes, robots, vehicles, or other conveyance mechanisms or devices may be utilized to provide items 117 (e.g., inventory items) to the item-aggregation station 103. The item input system 111 may provide items 117 to the first operator 109, for example. In operation, the first operator 109 may collect items 117 provided by the item input system 111 and sort items relative to the sortation wall 107. For example, the first operator 109 may aggregate items 117 together into groupings for orders or other collections of items 117 to be processed.

The system 101 may be arranged to facilitate a flow of items 117 in a particular direction through the system. For example, the item-aggregation station 103 may be on an upstream side of the sortation wall 107, while the packaging-processing station 105 may be on a downstream side of the sortation wall 107.

The sortation wall 107 can include loading apparatuses 119, e.g., which may facilitate collection and/or transfer of items 117 within receptacles 121 in use. In FIG. 1, the sortation wall 107 is shown with three banks that each include three columns with ten rows apiece for a total of ninety loading apparatuses 119, although any suitable number and/or arrangement may be utilized.

The loading apparatus 119 may facilitate transfer of items 117 within receptacles 121 that may be subject to various operations at the packaging-processing station 105. For ease of viewing, an example of a completed receptacle 121 is shown received on a takeaway conveyance system 129 of the packaging-processing station 105 in FIG. 1, although receptacles 121 carrying items 117 may be extracted from the loading apparatus 119 and/or subject to various operations at the packaging-processing station 105 in use.

The packaging-processing station 105 may be configured as a second operating environment for a second operator 123 and/or for processing packaging with completed orders therein. The second operator 123 may be tasked with operations, where at least some may relate to finalizing receptacles 121 for shipping or other transport. Examples of operations may include inserting empty receptacles 121 into the loading apparatuses 119, removing receptacles 121 containing items 117 from the loading apparatus 119, re-positioning of items 117 within the receptacle 121, removing items 117 from the receptacle 121, adding to the receptacle 121 (e.g., with packaging, cushioning, dunnage, labels, packing slips, manifests, missing items 117, or other supplemental material), closing, sealing, transferring, and/or other operations relative to the receptacle 121 and/or other elements. Operations may be performed relative to a receptacle 121 having a complete set of items 117 for an order or other purpose, for example.

The packaging-processing station 105 may include suitable structure to facilitate performance of associated operations. In various examples, the packaging-processing station 105 may include a cradle 125. The cradle 125 may correspond to a flat, curved, or otherwise suitably shaped shelf or platform for receiving a receptacle 121. The cradle 125 may be sized for receiving a receptacle 121 in an expanded configuration in use. The cradle 125 may function as a temporary staging area and/or may otherwise facilitate any of various operations to be performed at the packaging-processing station 105.

In some examples, the cradle 125 may be situated proximate to at least one sensor 127. The sensor 127 may include a camera, a bar code scanner, and/or any other sensor that may provide information for facilitating operations in use. The sensor 127 may be arranged to facilitate performance of recognition tasks relative to the receptacles 121 in use. As a non-limiting example, the sensor 127 may provide information to identify items 117 within a receptacle 121. Item-identification information may be utilized to determine if all intended items 117 and/or contents are within a receptacle 121, which may facilitate follow up operations involving adding or removing items 117 and/or contents to reach an intended combination of items 117 and/or contents within the receptacle 121, for example.

The packaging-processing station 105 may include a dispenser 128. The dispenser 128 may be positioned proximate the cradle 125, such as to facilitate ready usage of contents from the dispenser 128 at the cradle 125. The dispenser 128 may correspond to a printer, reel (such as of cushioning, labels, or other relevant supplemental material), or any other structure that may provide contents to be inserted into and/or onto a receptacle 121, an item 117, or other element in use.

Upon completion of a receptacle 121 to be ready for shipping or further processing, the receptacle 121 can be output from the packaging-processing station 105 by a takeaway conveyance system 129. For example, the second operator 123 may be tasked with transferring a receptacle 121 from the loading apparatus 119 and/or the cradle 125 to a conveyor belt or other suitable structure of the takeaway conveyance system 129. Although depicted as including a conveyor belt, the takeaway conveyance system 129 may utilize any suitable structure to accomplish its function, including, but not limited to examples of structures described for the item input system 111.

The packaging-processing station 105 can further include a supply depot 131. The supply depot 131 may include a rack, shelf, bin, or any suitable combination of these or other structures for storing supplies for the packaging-processing station 105. In some embodiments, the supply depot 131 can include one or more storage positions for empty receptacles 121, which may be in a collapsed configuration, for example. In operation, the second operator 123, upon finalizing a completed receptacle 121, may supply a collapsed, new, and/or fresh receptacle 121 into the loading apparatus 119 in use (e.g., from the supply depot 131). The receptacles 121 may occupy a smaller amount of space when collapsed (e.g., when in the supply depot 131) than when expanded (e.g., when being processed by the takeaway conveyance system 129). For example, the receptacles 121 may be reconfigurable between configurations discussed with respect to FIGS. 2A and 2B.

Figure 2B:
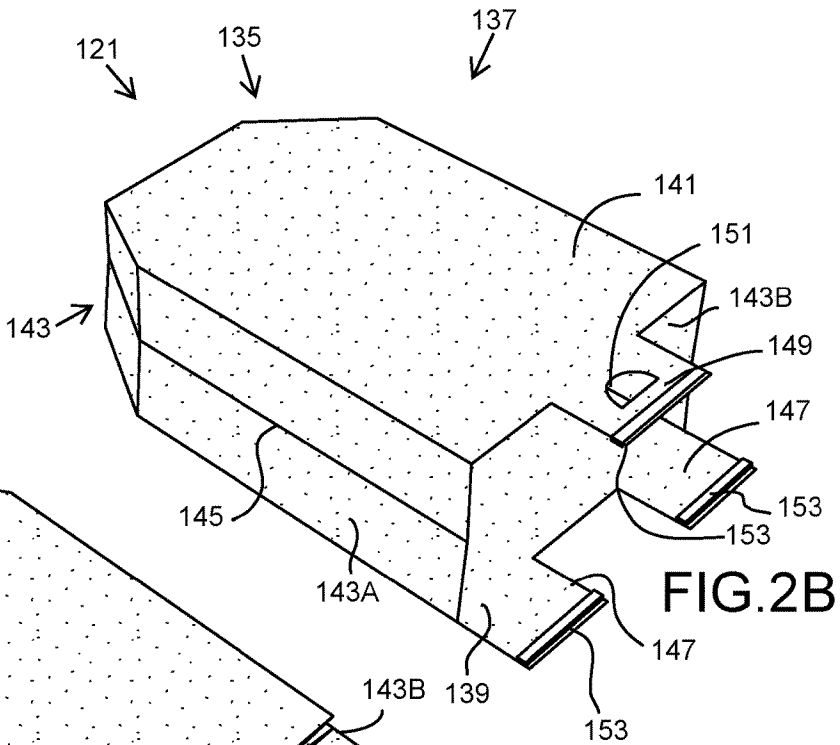
FIGS. 2A and 2B respectively illustrate examples of a collapsed configuration and an expanded configuration of a receptacle that may be utilized in the system of FIG. 1 in accordance with various embodiments.
Figure 2A:
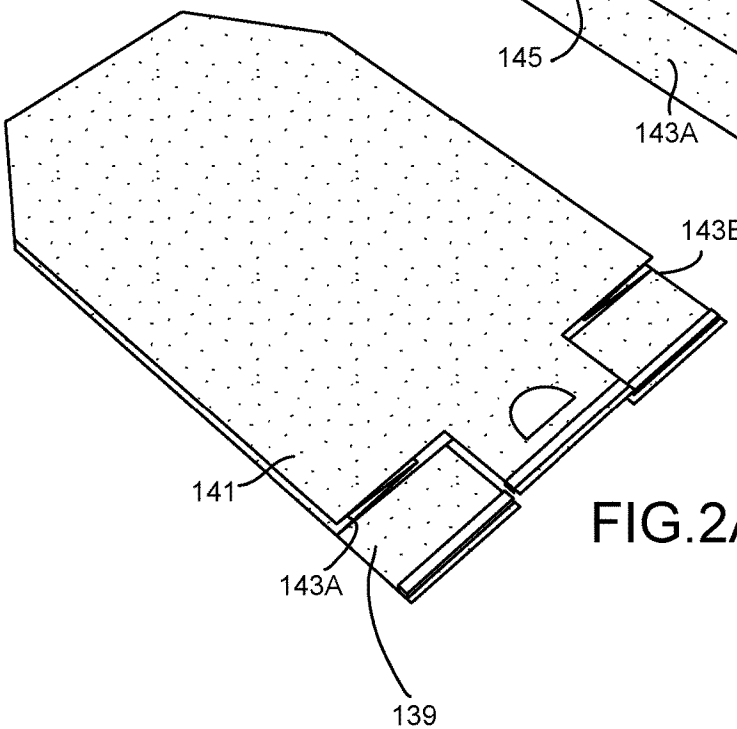

FIG. 2A illustrates an example of a receptacle 121 arranged in a collapsed configuration 133, while FIG. 2B shows an example of the receptacle 121 arranged in an expanded configuration 135. The receptacle 121 can include a wall set 137 that may define and/or include structure of the receptacle 121.

The wall set 137 may include any suitable material or combination of material. In some examples, the wall set 137 may be formed of paper, e.g., such that the receptacle 121 corresponds to a paper bag. However, the receptacle 121 is not so limited and may additionally or alternatively correspond to forms of collapsible containers that may include suitable cushioning and/or other materials. In some examples, the wall set 137 may include or be supplemented with cardboard, corrugate, or other suitable materials. The wall set 137 may include one or more walls formed as a flexible sheet or a rigid or semi-rigid panel. In some examples, plastic, wood, metal, or other materials may be used to form main bodies and/or reinforcing members in the wall set 137.

The wall set 137 may be sized to correspond to any suitable size of receptacle 121. In some embodiments, different sizes of receptacles may be utilized and selected from, such as based on a collection of items 117 to be included within the receptacle 121 in use. As a non-limiting example, in the expanded configuration 135, a small-size bag may measure 15.5 inches in length, 10.8 inches in width, and 4.18 inches in height; a medium-size bag may measure 19 inches in length, 12.6 inches in width, and 4.95 inches in height; and a large-size bag may measure 22 inches in length, 16 inches in width, and 6 inches in height, although any combination of sizes and corresponding dimensions may be utilized.

The wall set 137 may include a base wall 139 and a traveling wall 141. The base wall 139 and the traveling wall 141 may be arranged opposite one another.

The wall set 137 can include one or more collapsible walls 143. For example, the collapsible walls 143 are shown with at least a first lateral collapsible wall 143A and a second lateral collapsible wall 143B. The first lateral collapsible wall 143A and the second collapsible lateral wall 143B may be respectively left and right sides of the receptacle 121 with respect to an arrangement in which the base wall 139 is a front wall (arranged as a lower wall in the orientation shown in FIGS. 2A and 2B) and the traveling wall 141 is a rear wall (arranged as an upper wall in the orientation shown in FIGS. 2A and 2B). The collapsible walls 143 may be arranged such that the first lateral collapsible wall 143A is joining first lateral margins (e.g., left margins) of the base wall 139 and the traveling wall 141, while the second lateral collapsible wall 143B may be joining second lateral margins (e.g., right margins) of the base wall 139 and the traveling wall 141.

The base wall 139 and the traveling wall 141 may be spaced apart from one another in the expanded configuration 135 and/or may be in contact or proximate one another in the collapsed configuration 133. At least lateral margins of the base wall 139 and the traveling wall 141 may be held out of contact from one another by the collapsible walls 143 in the collapsed configuration 133, for example.

The collapsible walls 143 may include any suitable structure to facilitate collapsing. In the depicted example, the collapsible walls 143 include at least one seam or crease 145 that may allow folding along the seam or crease 145 as a hinge line so that the collapsible walls 143 may fold inward (e.g., like an accordion) and/or may be pulled out to form side walls that may be relatively flat instead of bent or folded in use.

The wall set 137 may further include structure that may be suitable for engaging structure of the loading apparatus 119. A tab 147 may be coupled with and/or included in the base wall 139. The tab 147 may extend from an adjacent portion of the base wall 139 and/or may form a portion of the base wall 139. The tab 147 may be sized or shaped according to one or more components of the loading apparatus 119 (such as structure described with respect FIG. 3 and other figures herein). A handle 149 may be coupled with and/or included in the traveling wall 141. The handle 149 may extend from an adjacent portion of the traveling wall 141 and/or may form a portion of the traveling wall 141. The handle 149 is also shown with a through hole 151. The through hole 151 may be sized or shaped according to one or more components of the loading apparatus 119 (such as structure described with respect FIG. 3 and other figures herein). The receptacle 121 in FIG. 2B is shown with two tabs 147 and one handle 149, although any suitable number and/or arrangement of tabs 147 and/or handles 149 may be utilized.

In some examples, closures 153 may be included on the tab 147 and/or the handle 149. Each instance of the closure 153 in FIG. 2B is depicted as an adhesive strip with a backing layer that may be removed to expose the adhesive so that the tab 147 and/or the handle 149 may be folded over and adhered to an outer surface of the receptacle 121 for securing the receptacle 121 in a closed state or otherwise finalizing the receptacle 121 for shipping or transport. Although depicted as adhesive strips that may be covered with backing layers until ready for use, the closures 153 may correspond to any other suitable form of closure, including, but not limited to, snaps, brads, strings, zippers, magnets, or other closures. The closures 153 may be useful for sealing the receptacle 121 after loading of the receptacle 121 has been completed in accordance with operations facilitated by interaction of the tab 147 and/or the handle 149 with structures described with respect to FIG. 3, for example.

Figure 3:
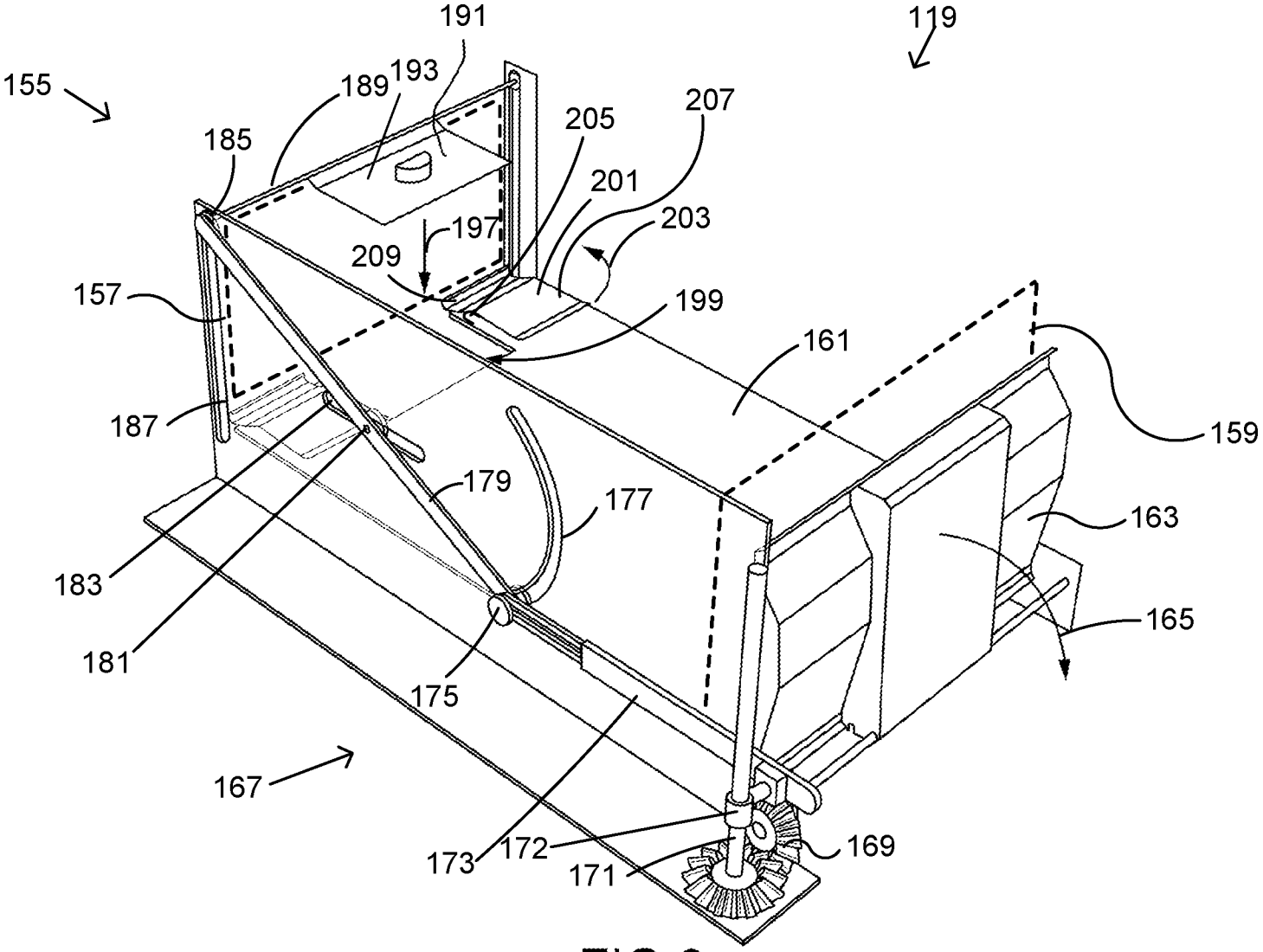
FIG. 3 illustrates elements of a loading apparatus that may be utilized in the system of FIG. 1 in accordance with various embodiments.

FIG. 3 illustrates elements of a loading apparatus 119. The loading apparatus 119 may be arranged or defined at least in part relative to a chute passageway 155. The chute passageway 155 may include an inlet opening 157 and an outlet opening 159. The inlet opening 157 may be arranged along the item-aggregation station 103, and the outlet opening 159 may be arranged along the packaging-processing station 105. The chute passageway 155 may further include a chute surface 161. The chute surface 161 may be arranged along and/or form at least a portion of a bottom of the chute passageway 155, for example.

The chute surface 161 may be arranged at an angle relative to horizontal. For example, the chute surface 161 may be declined from the inlet opening 157 toward the outlet opening 159. A decline may facilitate movement of contents through the chute passageway 155 under the effect of gravity. A decline angle of 10° relative to horizontal or other amount may be implemented. In some embodiments, the chute surface 161 may include a material, coating, and/or surface texture that exhibits a suitable coefficient of friction to resist sliding of a receptacle 121 when received along the chute surface 161, such as in the collapsed configuration 133. In some embodiments, a resistance provided by the chute surface 161 may be supplemented by other structure, such as a retainer 201 discussed further below.

The loading apparatus 119 can include a gate 163. The gate 163 is shown in a closed position in FIG. 3 but may be movable (such as depicted by arrow 165) toward other configurations (which may include some depicted in other figures herein). For example, the gate 163 may be moveable by movement imparted by the second operator 123 at the packaging-processing station 105 (e.g., by manual operation of pulling or pushing the gate 163). The gate 163 in the closed position may be capable of blocking access through the outlet opening 159. For example, the gate 163 may be sized to block passage of a receptacle 121 in either the collapsed configuration 133 (e.g., FIG. 2A) or the expanded configuration 135 (e.g., FIG. 2B).

The loading apparatus 119 may include a linkage 167. The linkage 167 may be mechanically coupled with the gate 163. For example, the linkage 167 may be arranged so as to move with the gate 163 and convert movement of the gate 163 into movement elsewhere. The linkage 167 is shown with structure including bevel gears 169 that may rotate a threaded shaft 171 to impart vertical movement to a threaded collar 172 on the threaded shaft 171, which may in turn cause vertical movement of a first rod 173 coupled with the threaded collar 172. The first rod 173 may in turn be coupled with a first pivot pin 175 that may ride in a first slot 177. The first slot 177 may be curved to guide movement of a second rod 179 of the linkage 167 that may be coupled via the first pivot pin 175 with the first rod 173. The second rod 179 (e.g., in a middle portion) may further be coupled with a second pivot pin 181 that may ride in a second slot 183, which may constrain an opposite end of the linkage 167 that may also include a third pivot pin 185 that may travel in a third slot 187. Overall, the linkage 167 may be coupled (e.g., via the third pivot pin 185) with a crossbar 189 that may be movable, for example, up and down in response to the linkage 167 converting movement of the gate 163 in use.

The loading apparatus is also shown with a splitter 191. The splitter 191 is shown as a plate 193 having a tooth or protrusion 195, although the splitter 191 may include any other suitable structure in use. The splitter 191 may be coupled with the crossbar 189 to be movable by the linkage 167 in response to movement of the gate 163. Although a specific linkage 167 and associated subcomponents are shown in FIG. 3, other types of linkages may be utilized, including but not limited to, linkages shown in FIG. 8. The splitter 191 may be capable of moving downward (e.g., as depicted by arrow 197), such as in response to the gate 163 being opened (as illustrated by arrow 165). Moving the splitter 191 downward may allow the splitter 191 to move through a cut out 199, which may be formed in the chute surface 161 (e.g., at an end and/or proximate the inlet opening 157). The cut out 199 maybe sized to permit the splitter 191 to move through the cut out 199 to a position within or below the cut out 199 in use.

The loading apparatus 119 is also shown with a retainer 201. The retainer 201 may be movable (such as depicted by arrow 203). For example, the retainer 201 may be capable of pivoting upward and/or downward. The retainer 201 is depicted as including a pivoting plate, although any suitable form factor may be utilized. The retainer 201 may be coupled with a biasing member 205 that may be a torsion spring or other biasing member that may bias the retainer 201 toward a particular position, such as that shown, and/or for imparting a clamping force in use. For example, the retainer 201 may serve to clamp or otherwise secure the base wall 139 of the receptacle 121 in position along the chute surface 161, such as to supplement a resistance to movement from friction along the chute surface 161 and/or to otherwise resist movement of the receptacle 121 along the chute surface 161. In some embodiments, friction along the chute surface 161 may be sufficient to retain positioning of the receptacle 121 in the collapsed configuration 133, while the retainer 201 may be especially useful to retain the receptacle in the expanded configuration 135 (e.g., when a weight of the receptacle 121 may be relatively higher due to items 117 being included therein).

The retainer 201 is shown with a panel 207 that includes a groove 209. The groove 209 may be sized for engagement with the crossbar 189 in use. As an illustrative example, movement of the gate 163 in an opening direction (as depicted by arrow 165) may impart movement through the linkage 167 to the crossbar 189 to cause the splitter 191 to move downward (as depicted by arrow 197) such that the crossbar 189 engages the groove 209 and overcomes a biasing force imparted by the biasing member 205 to cause the retainer 201 to rotate upward (as depicted by arrow 203)

and maintain the retainer 201 in the released position by the crossbar 189 engaging the groove 209. Such movements may for example, result in reaching a state shown in FIG. 4A and/or 4B.

Figure 4B:
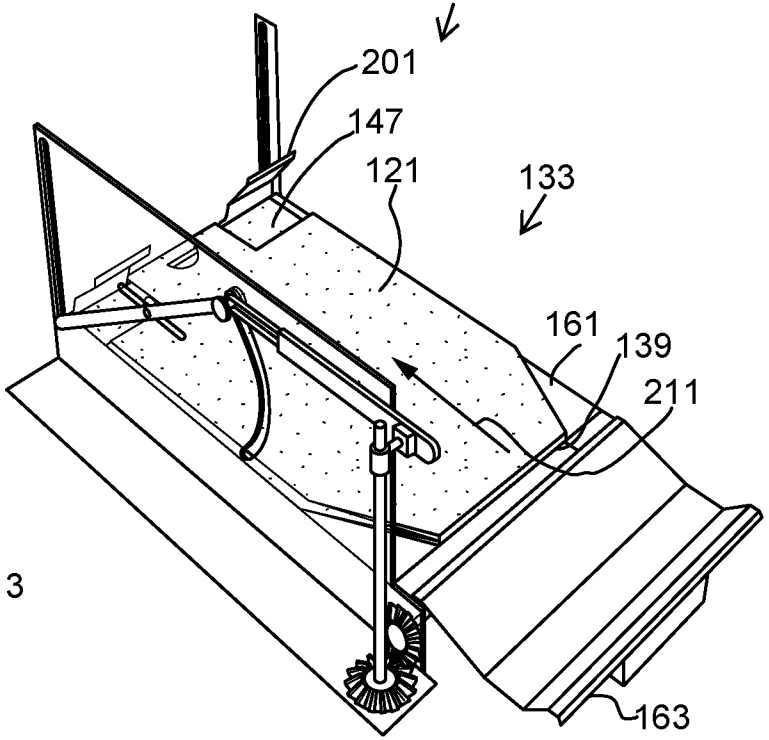
FIG. 4B illustrates elements of the loading apparatus of FIG. 3 in an arrangement in which a receptacle is received in the loading apparatus in accordance with various embodiments.
Figure 4A:
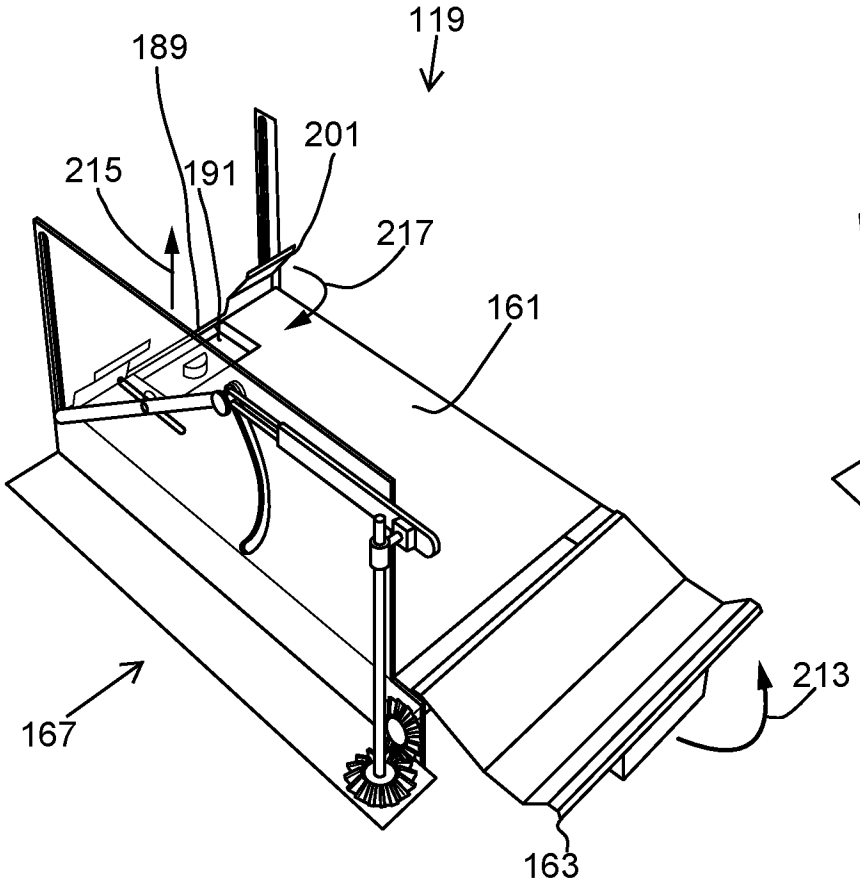
FIG. 4A illustrates elements of the loading apparatus of FIG. 3 in an arrangement in which the gate is arranged in an open position in accordance with various embodiments.

FIG. 4A illustrates elements of the loading apparatus 119 in an arrangement in which the gate 163 is arranged in an open position. For example, the components may arrive at the depicted arrangement in response to movement along the arrows 165, 197, and 203 depicted in FIG. 3. The components in FIG. 4B are shown in an identical state as in FIG. 4A, except that FIG. 4B also depicts a receptacle 121 received into the loading apparatus 119. For example, FIG. 4B may correspond to an occupied state in which the receptacle 121 is present in the chute passageway 155 of FIG. 3, and FIG. 4A may correspond to an unoccupied state in which the receptacle 121 is not present in the chute passageway 155 of FIG. 3. Referring further to FIG. 4B, the receptacle 121 in the occupied state may be arranged so that the base wall 139 is arranged along and/or facing the chute surface 161. The receptacle 121 in FIG. 4B may be installed in the collapsed configuration 133. As depicted by arrow 211, the receptacle 121 may be inserted with the gate 163 in the open position (e.g., through the outlet opening 159 identified in FIG. 3).

FIG. 4A and FIG. 4B may correspond to sequential states within a process of use of the loading apparatus 119 (e.g., respectively before and after installation of a receptacle 121). Further figures herein similarly depict other views with and without the receptacle 121 for ease of viewing respective positioning of components. Various figures are arranged in pairs that each include an "A" suffix and a "B" suffix, where the figures with suffix "B" may correspond to further sequential states within the process involving the receptacle 121, while the figures with suffix "A" may be seen alongside as a representation with the receptacle 121 omitted from view for ease of seeing associated positioning of components of the loading apparatus 119.

With reference still to FIGS. 4A and 4B, the retainer 201 may be positioned to permit elements of the receptacle 121 to be introduced underneath and/or nearby. For example, the retainer 201 may be arranged in an upwardly pivoted state to facilitate insertion of the receptacle 121. Following insertion of the receptacle 121 (as at arrow 211), the retainer 201 may at least partially overhang the tab 147 of the base wall 139 of the receptacle 121, and/or the tab 147 may be positioned under an overhanging portion of the retainer 201 but not yet in contact and/or clamped by the retainer 201, for example.

Following insertion of the receptacle 121 (as at arrow 211), the gate 163 may begin to undergo a closing motion (as at arrow 213), such as in response to operation by the second operator 123 (FIG. 1). Movement of the gate 163 toward closed (e.g., as illustrated by arrow 213) may impart movement to the linkage 167 that may in turn impart motion to the splitter 191 and crossbar 189 (such as depicted by arrow 215). Movement of the crossbar 189 upward (as depicted by arrow 215) may cause the crossbar 189 to disengage grooves 209 in the retainer 201 and cause movement (such as depicted by arrow 217) of the retainer 201 toward (e.g., downward toward) the chute surface 161 in use. The loading apparatus 119 may switch from a state shown in FIG. 4A and/or 4B to a state shown in FIGS. 5A and 5B by movements depicted by the respective arrows 213, 215 and 217 in FIG. 4A, for example.

Figure 5B:
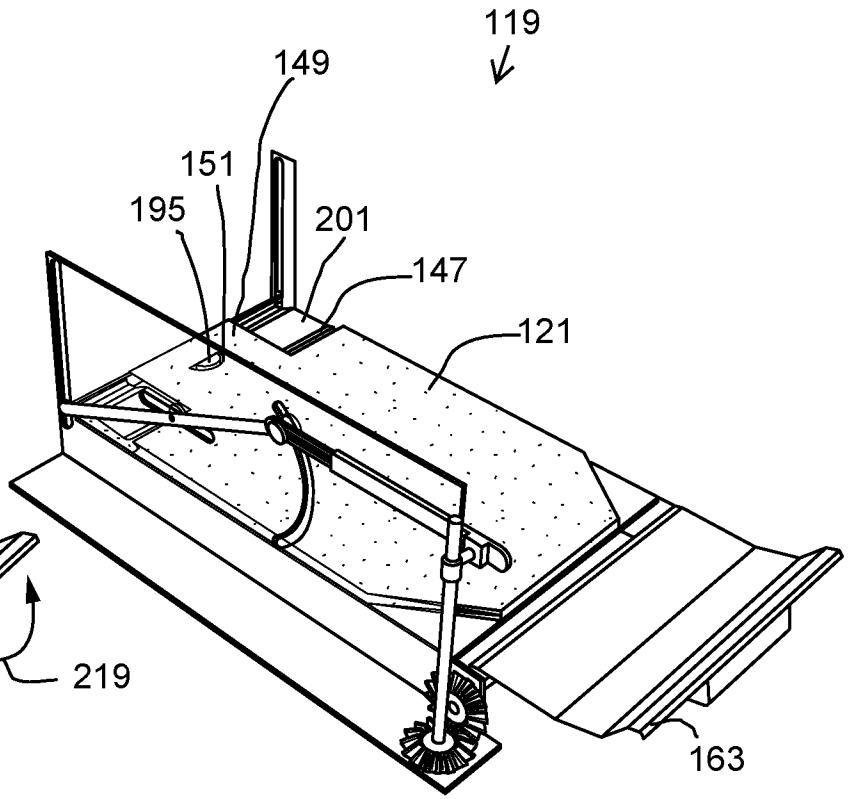
FIGS. 5A and 5B illustrates elements of the loading apparatus of FIG. 3 in an arrangement for engaging a retainer with a base wall of the receptacle in accordance with various embodiments.
Figure 5A:
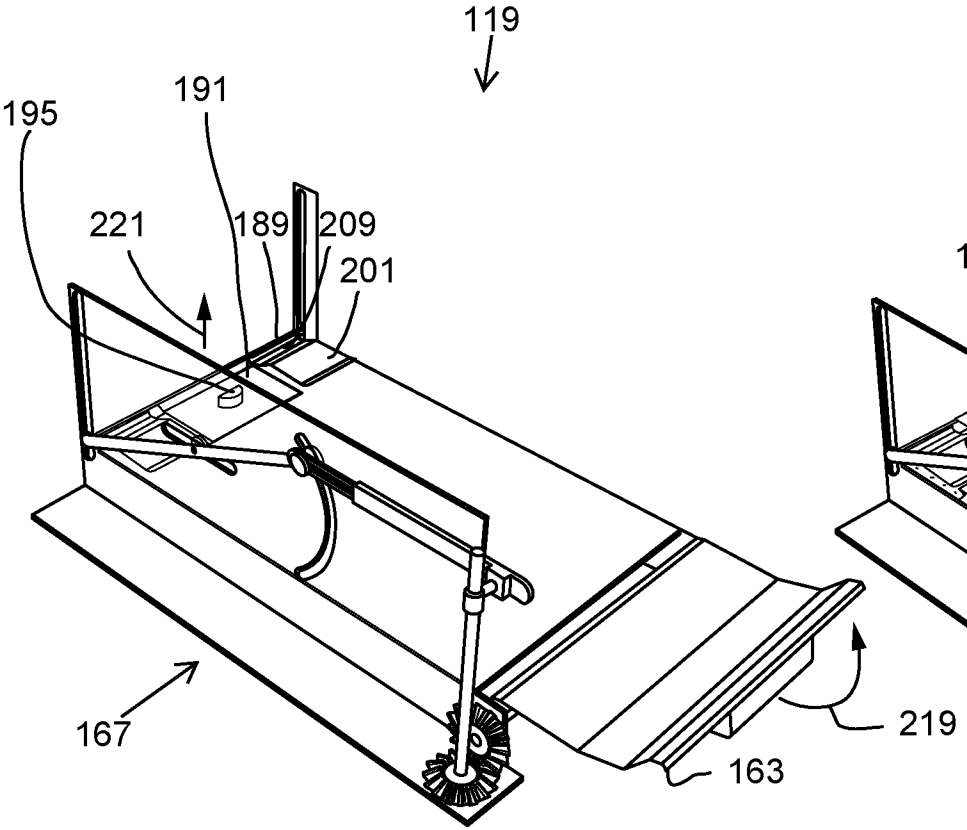

FIGS. 5A and 5B illustrate a state in which the gate 163 has been moved further toward closed than in FIGS. 4A and 4B. Furthermore, FIGS. 5A and 5B show an example of the loading apparatus 119 in a state with the retainer 201 in an engaged position. In the engaged position, the retainer 201 may engage or clamp against the tab 147 of the receptacle 121. The depicted state may be a result of the crossbar 189 moving out of engagement with the groove 209 on the retainer 201 in response to movement of the linkage 167 that is converted by initial movement of the gate 163 away from the open position in FIG. 4A (e.g., and toward the closed position in FIG. 3). For example, with the crossbar 189 out of the groove 209, the biasing member 205 (FIG. 3) may urge the retainer 201 toward the engaged position (e.g., FIG. 5B) and away from a released position (e.g., FIG. 4B).

The splitter 191 may engage the handle 149 in any suitable fashion. In the position shown in FIGS. 5A and 5B, the splitter 191 may be arranged flush within the cut out 199. With such placement, the protrusion 195 of the splitter 191 may be arranged extending through the through hole 151 of the handle 149 of the receptacle 121. This may be a result of the splitter 191 rising through the cutout 199 in use, such as in response to movement described by arrow 215 in FIG. 4A.

Continued closing of the gate 163 (e.g., as that arrow 219) may impart or cause continued upward motion (as at arrow 221) of the crossbar 189 and splitter 191. This may allow for movement of the components of the loading apparatus 119 to shift from the state shown in FIGS. 5A and 5B to the state shown in FIGS. 6A and 6B.

Figure 6B:
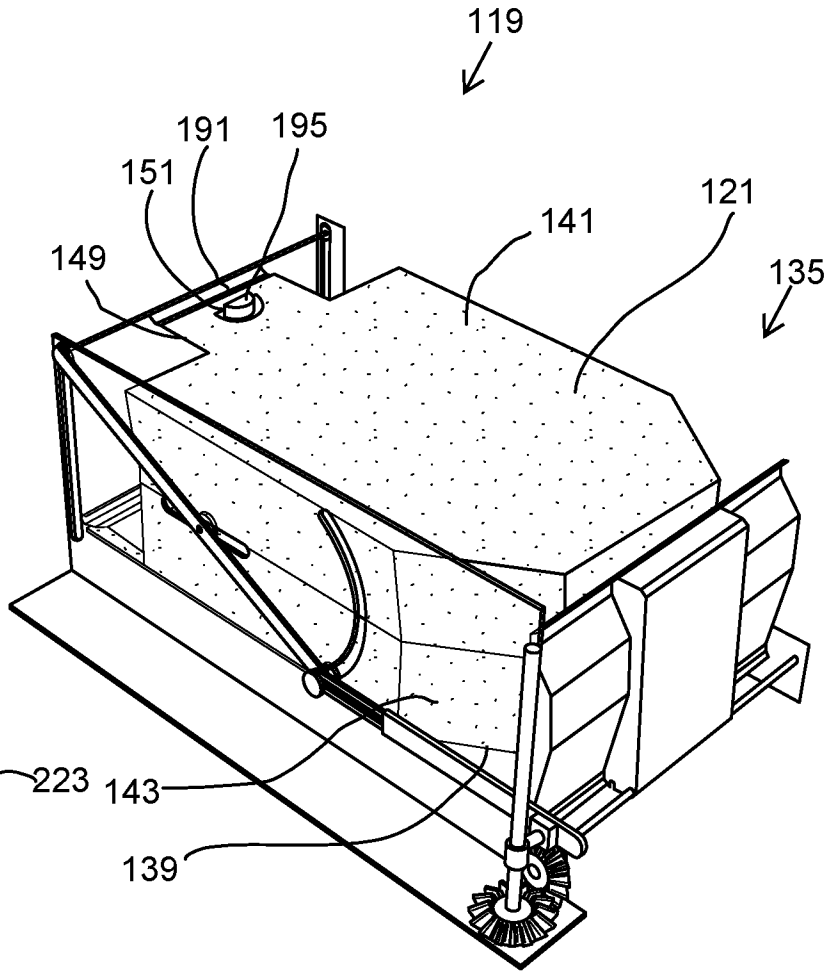
FIGS. 6A and 6B illustrates elements of the loading apparatus of FIG. 3 in an arrangement for splitting a traveling wall of the receptacle from the base wall of the receptacle in accordance with various embodiments.
Figure 6A:
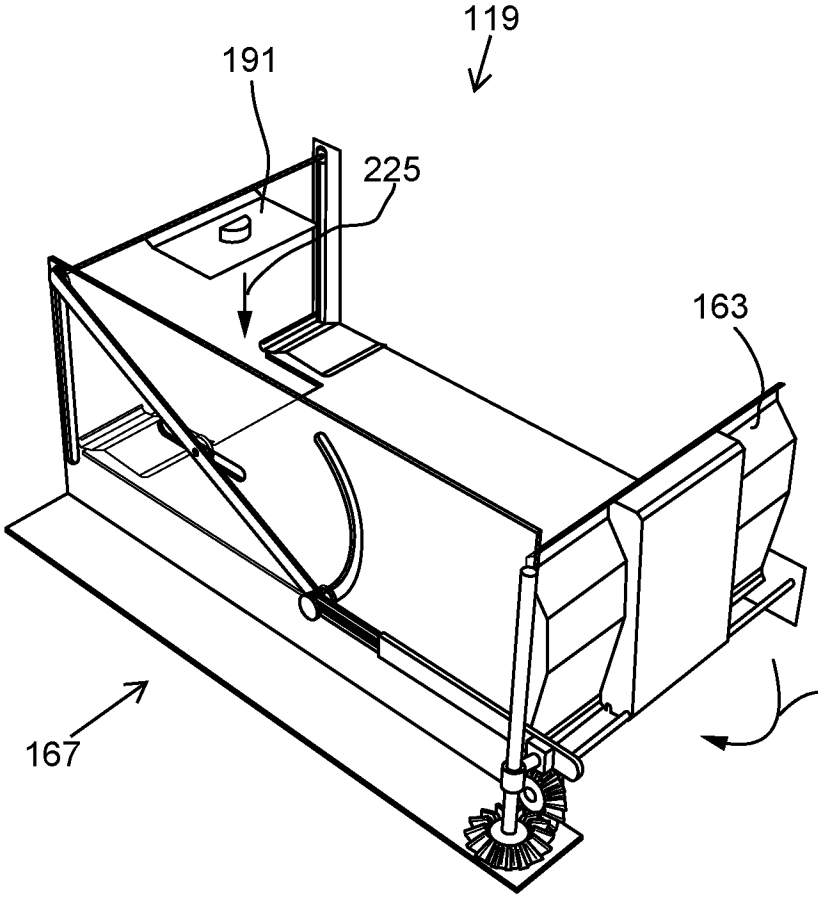

FIGS. 6A and 6B illustrate show an example of the loading apparatus 119 in a state with the splitter 191 in an away position. The state depicted in FIGS. 6A and 6B may be reached by the arrows 219 and 221 depicted in FIGS. 5A and 5B, for example. Movement of the gate 163 may cause the splitter 191 to move (e.g., upwardly or otherwise in a suitable path) and split the upper or traveling wall 141 from the lower or base wall 139. This may include the splitter 191 and the protrusion 195 engaging the through hole 151 of the handle 149. In operation, this may correspond to the traveling wall 141 being pulled upward and causing the collapsible walls 143 to unfold and/or otherwise extend so that the receptacle 121 arrives at an expanded configuration 135.

With reference to FIG. 6A, the gate 163 may be opened (as depicted by arrow 223). Through the linkage 167, this may impart movement that in use may lower the splitter 191 (such as depicted by arrow 225). For example, the splitter 191 may retract downward toward a position shown in FIGS. 7A and 7B.

Figure 7B:
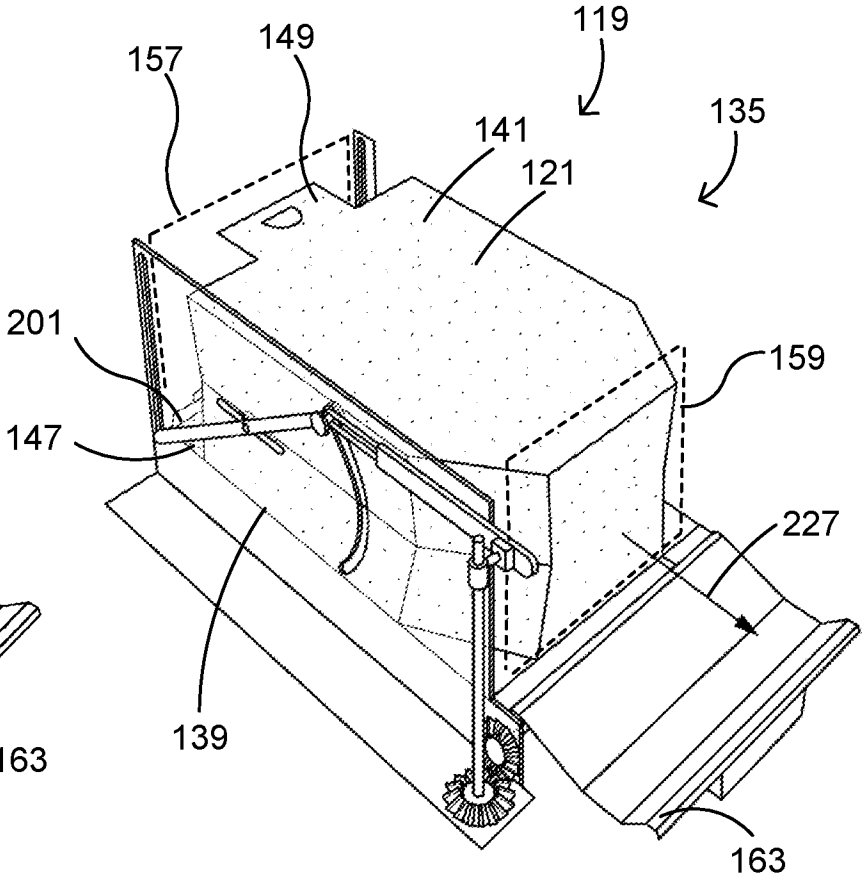
FIGS. 7A and 7B illustrates elements of the loading apparatus of FIG. 3 in an arrangement for permitting extraction of the receptacle in accordance with various embodiments.
Figure 7A:
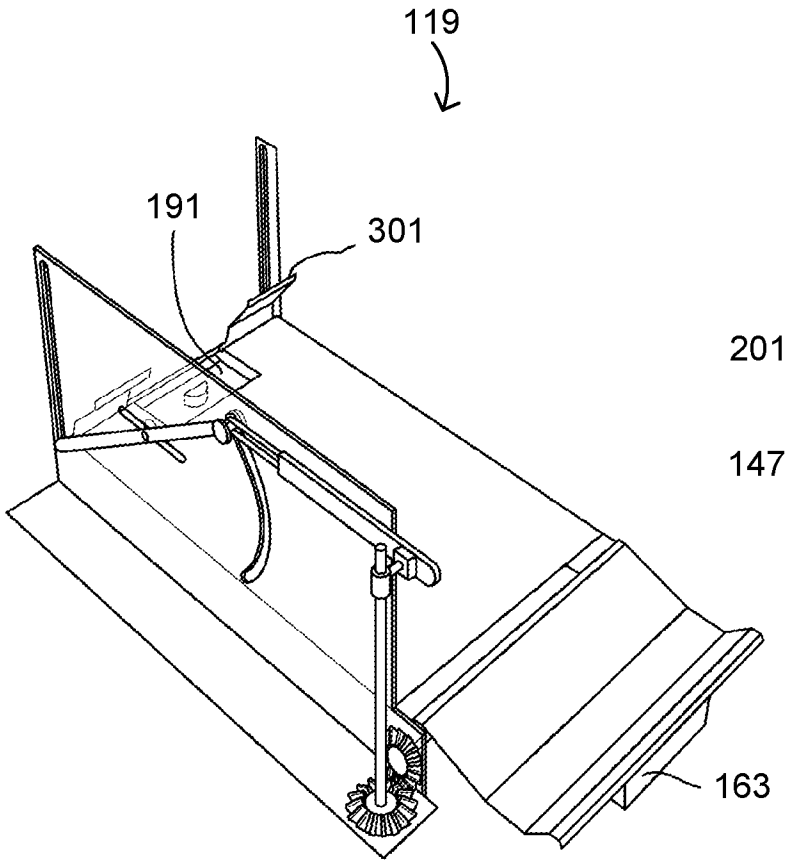

FIGS. 7A and 7B show an example of the loading apparatus 119 in a state in which the splitter 191 is fully retracted from the handle 149 of the receptacle 121. The gate 163 is shown open in FIGS. 7A and 7B. The open position of the gate 163 may correspond also to the retainer 201 being disengaged from the tab 147 of the base wall 139 of the receptacle 121. The traveling wall 141 may be retained with the receptacle 121 in the expanded configuration 135 based on items that may have been loaded into the receptacle 121 from the inlet opening 157 in operation.

The receptacle 121 may be removed through the outlet opening 159, such as depicted by arrow 227. Removal of the receptacle 121 may be facilitated by the retainer 201 and/or the splitter 191 being disengaged from the receptacle 121 (e.g., which may include being in or out of contact and otherwise not resisting movement for removing the receptacle 121). Removing the receptacle 121 may position the elements of the loading apparatus 119 in a suitable position to resume at the state shown in FIG. 4A, which may correspond to a position ready for introduction of another instance of the receptacle 121, such as at FIG. 4B. In this manner, the loading apparatus 119 may be cycled to allow use of the loading apparatus 119 for different instances of the receptacle 121 in use. For example, with the gate 163 in the open position, the splitter 191 may be arranged in a home position in which the splitter 191 is arranged to be disengaged from the receptacle 121. Positioning the splitter 191 to be disengaged from the receptacle 121 may facilitate removal of the receptacle 121 from the chute passageway (e.g., after loading with items 117) and/or may facilitate introduction of the same or another receptacle 121 into the chute passageway 155 (e.g., prior to loading with items 117).

Figure 8:
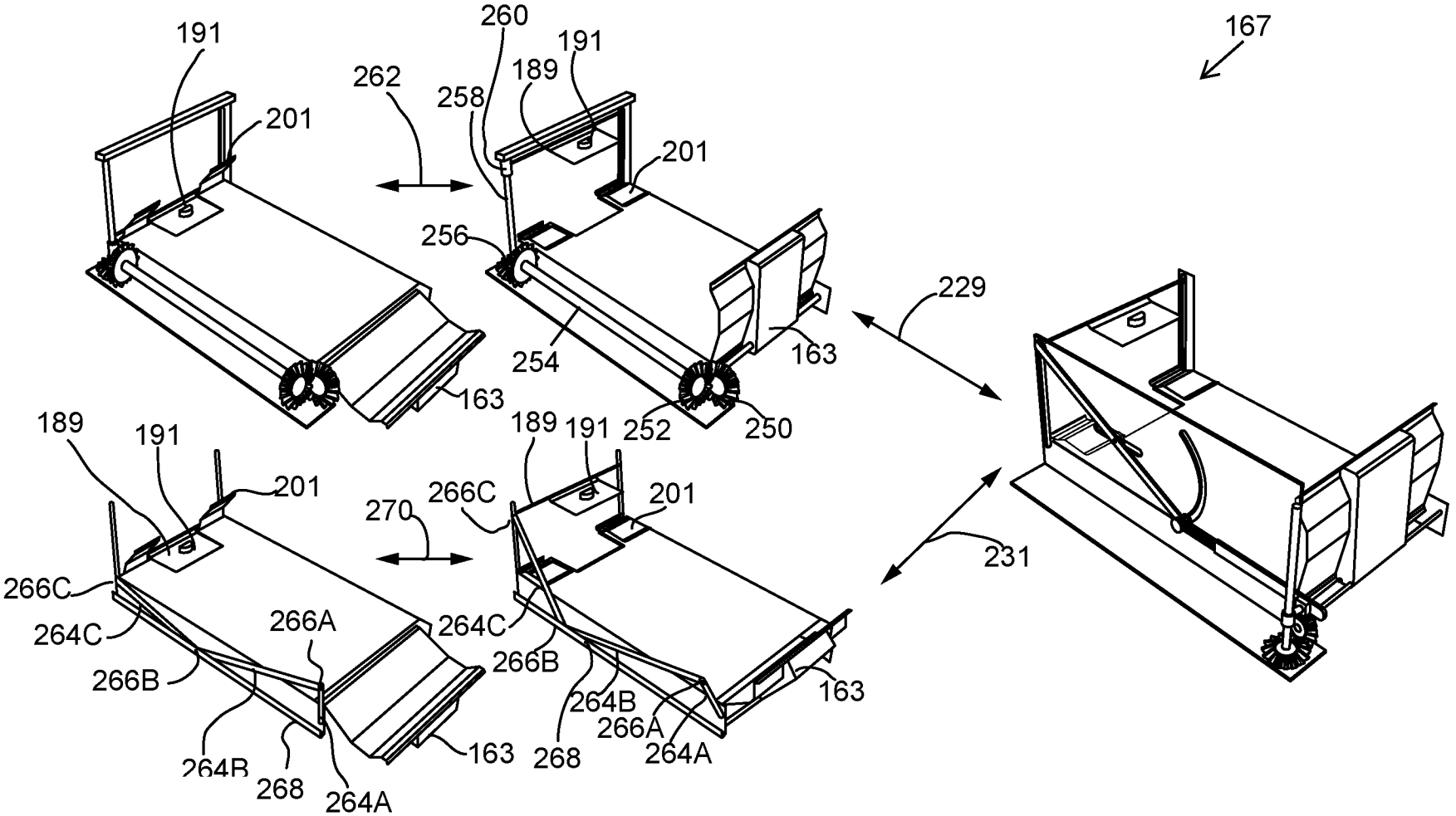
FIG. 8 illustrates various examples of components that may be implemented in a linkage in the loading apparatus of FIG. 3 in accordance with various embodiments.

FIG. 8 illustrates various examples of components that may be implemented in the linkage 167. For example, as depicted by arrows 229 and 231, the linkage 167 may be altered so that components described with respect to FIG. 3 may be replaced with other elements for the linkage 167. Any suitable components that may permit movement of the gate 163 to be converted into movement of the splitter 191 and/or retainer 201 may be utilized. For example, as shown by arrow 229, the linkage 167 may incorporate elements that include a first bevel gear 250 that may be engaged with a second bevel gear 252 that may drive a shaft 254 that may in turn through a further bevel gear interface 256 operate a threaded rod 258 to cause the crossbar 189 to move in response to a threaded collar 260. Thus, movement may be imparted between different states, such as shown by arrow 262.

In another example, as depicted by arrow 231, the linkage 167 may be modified to include an arrangement in which a set of three rods 264A, 264B, and 264C are coupled by respective pivot pins 266A, 266B, and 266C so that a middle pivot pin 266B travels in a track 268 to cause the linkage 167 and respective rods 264A, 264B, and 264C to be constrained to move the crossbar 189 (and in turn the splitter 191 and/or retainer 201) through appropriate positions in operation (such as depicted by arrow 270). Although some examples of suitable linkages 167 are thus shown in FIG. 8, any other linkage that may provide suitable corresponding motion transfer from the gate 163 to the splitter 191 and/or retainer 201 may be utilized.

Figure 9:
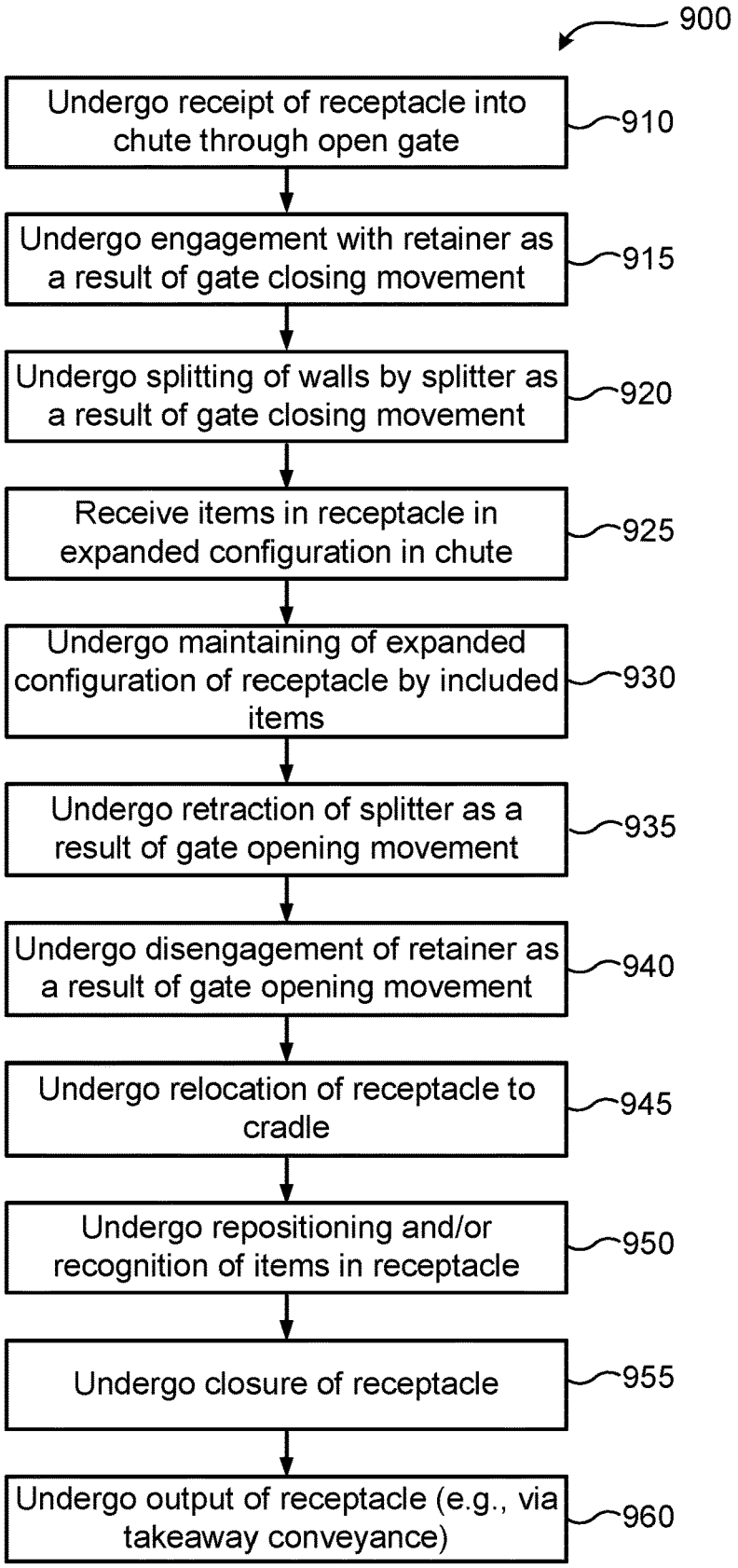
FIG. 9 is a flow chart illustrating a process that may be utilized and/or implemented relative to the system of FIG. 1 in accordance with various embodiments.

FIG. 9 is a flow chart illustrating a process 900 that may be utilized and that may be conducted by the system 101, with respect to components thereof, and/or with respect to a receptacle that may be processed through the system 101. Some or all of the process 900 (or any other processes described herein, or variations, and/or combinations thereof) may be performed under the control of one or more computer systems configured with executable instructions and may be implemented as code (e.g., executable instructions, one or more computer programs, or one or more applications) executing collectively on one or more processors, by hardware or combinations thereof. The code may be stored on a computer-readable storage medium, for example, in the form of a computer program comprising a plurality of instructions executable by one or more processors. The computer-readable storage medium may be non-transitory. In various examples, example, operations in the process 900 may be operations performed relative to the receptacle 121.

At 910, the process 900 can include undergoing receipt of the receptacle into the chute passageway through the gate in the open position. This may correspond to performance of suitable actions to accomplish loading of the receptacle 121 into the loading apparatus 119. For example, the second operator 123 (FIG. 1) may access the supply depot 131, retrieve a receptacle 121 in the collapsed configuration 133 (FIG. 2), and insert the collapsed receptacle 121 into the loading apparatus 119. In some embodiments, this may be performed relative to a gate 163 that is still open from an operation of removing a full or completed receptacle 121, or this may be performed in association with opening a gate 163 for an empty or unoccupied loading apparatus 119. With respect to features identified in FIG. 3, insertion may include passage into the chute passageway 155 through the opening outlet opening 159. Such insertion may be performed (such as depicted in FIG. 4B by arrow 211) with the gate 163 in the open position. The chute surface 161 may be exposed due to the gate 163 being in the open position, and the base wall 139 of the receptacle 121 may be received along the exposed chute surface 161.

At 915, the process 900 can include undergoing engagement of the base wall of the receptacle with the retainer moved into an engaged position as a result of movement of the gate from the open position toward the closed position. For example, the retainer 201 may reach an engaged position shown in FIG. 5B in response to closing movement of the gate 163 (e.g., depicted by arrow 213 in FIG. 4A), which may be transferred by the linkage 167 to move the crossbar 189 (as depicted by arrow 215 in FIG. 4A) out of engagement with the retainer 201 so that the retainer 201 is permitted to move by the action of the biasing member 205 to pivot downward (e.g., as depicted by arrow 217 in FIG. 4A) and clamp down on the tab 147 of the receptacle 121 (e.g., in a position shown in FIG. 5B).

At 920, the process 900 can include undergoing splitting of the traveling wall from the base wall of the receptacle to shift the receptacle from a closed or a collapsed configuration to an expanded configuration due to the splitter moving the traveling wall as a result of movement of the gate from the open position toward the closed position. For example, this may correspond to closure of the gate 163 causing movement through the linkage 167 that drives the splitter 191 to move from a home position (e.g., which may correspond to the position shown in FIG. 4A and/or 4B) to an away position (e.g., which may correspond to the position shown in FIG. 6A and/or 6B). Movement of the splitter 191 from the home position toward an away position may cause the splitter 191 to engage the handle 149 and shift the receptacle 121 from the collapsed configuration 133 to the expanded configuration 135 (e.g., to arrive at the position depicted in FIG. 6B). In the expanded configuration, an open end of the receptacle 121 may face the inlet opening 157 (FIG. 3) and/or the item-aggregation station 103 (FIG. 1), e.g., which may suitably position the receptacle 121 for receipt of items 117.

At 925, the process 900 can include receiving items in the receptacle in an expanded configuration in the chute. For example, with respect to features described in FIG. 1, the first operator 109 at the item-aggregation station 103 may deposit items 117 from the item input system 111 into the receptacle 121, which may be in the chute passageway 155 (e.g., FIG. 3) and arranged in the expanded configuration 133 (e.g., FIG. 2B). The items 117 may be deposited through an open end of the receptacle 121 that may result from action of the splitter 191 (e.g., FIG. 6B).

At 930, the process 900 can include undergoing maintaining of the expanded configuration of the receptacle, at least in part by the items received within the receptacle. For example, the receptacle 121 may remain in the expanded configuration 135 (e.g., FIG. 6B) at least in part due to items 117 placed in the receptacle 121 serving to hold the receptacle 121 open with the traveling wall 141 and base wall 139 spaced apart. After all items 117 (e.g., FIG. 1) designated for the receptacle 121 are within the receptacle 121 (e.g., based on completion of depositing of items 117 by the first operator 109 at the item-aggregation station 103), the gate 163 of the loading apparatus 119 may be opened (e.g., by the second operator 123 at the packaging-processing station 105), which may suitably arrange components to facilitate removal of the receptacle 121 from the chute passageway 155 (FIG. 3) of the loading apparatus 119.

At 935, the process 900 can include undergoing retraction of the splitter from the traveling wall of the receptacle in the expanded configuration as a result of movement of the gate from the closed position toward the open position. For example, the splitter 191 may move from an away position shown in FIG. 6B to a home position shown in FIG. 7B based on movement transferred through the linkage 167 from the gate 163 being opened (as illustrated by arrow 223 in FIG. 6A). Even after the splitter 191 is retracted or returned toward a home position (as in FIG. 7B), items 117 in the receptacle 121 may hold the traveling wall 141 and base wall 139 spaced apart.

At 940, the process 900 can include undergoing disengagement of the base wall of the receptacle due to the retainer being moved into a released position as a result of movement of the gate from the closed position toward the open position. For example, opening of the gate 163 (as at 223 in FIG. 6A) may impart movement through the linkage 167 that may in turn cause the crossbar 189 to lower into contact with the retainer 201 (e.g., 7B) and cause the retainer 201 to pivot upward (e.g., counter to the effect of the biasing member 205 denoted in FIG. 3) so that the retainer 201 releases the tab 147 of the base wall 139 of the receptacle 121 (e.g., to arrive at the position shown in FIG. 7B).

At 945, the process 900 can include undergoing relocation of the receptacle to a cradle. For example, the receptacle 121 (e.g., in the expanded configuration 135 and containing introduced items 117) may be moved relative to elements shown in FIG. 1, such as being moved (e.g., by the second operator 123 at the packaging-processing station 105) from the loading apparatus 119 to the cradle 125, which may suitably position the receptacle 121 for other operations.

At 950, the process 900 can include undergoing repositioning or recognition of items within the receptacle at the cradle. For example, at the cradle 125, the sensor 127 may provide information suitable for performing recognition of items 117 in the receptacle 121, which may facilitate instructions about other actions to be taken relative to the receptacle 121. In various embodiments, at the cradle 125, the second operator 123 may perform actions, such as based on instructions generated based on the sensor 127 (e.g., if present) or independently (e.g., if the sensor 127 is not present or is inoperable or otherwise not utilized in generating instructions). Non-limiting examples may include the second operator 123 repositioning items 117 within the receptacle 121 (e.g., to better arrange for closure etc.), removing items 117 from the receptacle 121, and/or adding to the receptacle 121 (e.g., with packaging, cushioning, dunnage, labels, packing slips, manifests, missing items 117, or other supplemental material).

At 955, the process 900 can include undergoing closure of the receptacle. For example, the second operator 123 (e.g., FIG. 1) may close and/or seal the receptacle 121 in the expanded configuration 135 and with items 117 inside. In some embodiments, closure may involve implementing closures 153 (e.g., FIG. 2B) and/or folding or otherwise manipulating the tab 147 and/or handle 149 of the receptacle 121 into position for reaching a closed and/or sealed state.

At 960, the process 900 can include undergoing output of the receptacle via a takeaway conveyance. For example, the second operator 123 at the packaging-processing station may be tasked with transferring the completed receptacle 121 from a suitable pickup location (such as the loading apparatus 119 and/or the cradle 125) and re-locating to a conveyor belt or other structure of the takeaway conveyance system 129, which may transfer the completed receptacle 121 to a delivery vehicle or other suitable structure for subsequent shipping or other actions.

Based on the disclosure and teachings provided herein, a person of ordinary skill in the art will appreciate other ways and/or methods to implement the various embodiments. The specification and drawings are, accordingly, to be regarded in an illustrative rather than a restrictive sense. It will, however, be evident that various modifications and changes may be made thereunto without departing from the broader spirit and scope of the disclosure as set forth in the claims.

Other variations are within the spirit of the present disclosure. Thus, while the disclosed techniques are susceptible to various modifications and alternative constructions, certain illustrated embodiments thereof are shown in the drawings and have been described above in detail. It should be understood, however, that there is no intention to limit the disclosure to the specific form or forms disclosed, but on the contrary, the intention is to cover all modifications, alternative constructions, and equivalents falling within the spirit and scope of the disclosure, as defined in the appended claims.

The use of the terms "a" and "an" and "the" and similar referents in the context of describing the disclosed embodiments (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the disclosure and does not pose a limitation on the scope of the disclosure unless otherwise claimed. No language in the specification should be construed as indicating any non-claimed element as essential to the practice of the disclosure.

Disjunctive language such as the phrase "at least one of X, Y, or Z," unless specifically stated otherwise, is intended to be understood within the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

Preferred embodiments of this disclosure are described herein, including the best mode known to the inventors for carrying out the disclosure. Variations of those preferred embodiments may become apparent to those of ordinary skill in the art upon reading the foregoing description. The inventors expect skilled artisans to employ such variations as appropriate and the inventors intend for the disclosure to be practiced otherwise than as specifically described herein.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. An inventory management system, comprising:

an item-aggregation station configured as a first operating environment for a first operator;

a packaging-processing station configured as a second operating environment for a second operator to work with a receptacle that is a paper bag having a base wall and a traveling wall joined by collapsible walls;

a sortation wall between the item-aggregation station and the packaging-processing station; and a loading apparatus incorporated into the sortation wall and comprising:

a chute passageway including a chute surface positioned extending along at least a portion of a distance between an inlet opening facing the item-aggregation station and an outlet opening facing the packaging-processing station;

a gate arranged to be operable from the packaging-processing station, the gate moveable to an open position permitting passage for introduction of the paper bag by the second operator through the outlet opening to position the base wall of the paper bag against the chute surface, the gate further moveable to a closed position obstructing passage of the paper bag through the outlet opening;

a linkage mechanically coupled with the gate so as to move with the gate and convert movement of the gate into movement elsewhere; and a splitter coupled with the linkage and moveable by the linkage in response to movement of the gate from the open position toward the closed position to move the splitter from a home position toward an away position, wherein during movement of the splitter toward the away position, the splitter is arranged to engage the paper bag so as to split the traveling wall of the paper bag away from the base wall of the paper bag and shift the paper bag from a collapsed configuration to an expanded configuration suitable for loading of items by the first operator through the inlet opening at the item-aggregation station.

2. The system of claim 1, wherein the linkage is further configured to convert movement of the gate toward the open position into movement of the splitter toward the home position, wherein the splitter in the home position is arranged to be disengaged from the paper bag to facilitate removal of the paper bag from the chute passageway after loading with items.

3. The system of claim 1, further comprising a retainer including a clip moveable between an engaged position and a released position, the clip in the engaged position clamping against a portion of the base wall of the paper bag and resisting movement of the paper bag along the chute surface, the clip in the released position disengaged from the base wall of the paper bag and permitting movement of the paper bag along the chute surface, wherein the splitter in the home position is arranged to hold the retainer in the released position, and wherein the splitter in the away position is arranged to permit the retainer to be in the engaged position.

4. The system of claim 1, further comprising the paper bag.

5. The system of claim 4, wherein the receptacle comprises:

the base wall;

the traveling wall, wherein the traveling wall is positioned opposite the base wall;

the collapsible walls, wherein the collapsible walls comprise a first collapsible wall joining first lateral margins of the base wall and the traveling wall, and wherein the collapsible walls comprise a second collapsible wall joining second lateral margins of the base wall and the traveling wall;

a tab coupled with or included in the base wall and configured to be engaged by a retainer to maintain a position of the base wall during movement of the traveling wall; and a handle coupled with or included in the traveling wall and configured to be engaged by the splitter to impart movement to the traveling wall so as to split the traveling wall away from the base wall and shift the receptacle from a collapsed arrangement to an expanded arrangement suitable for loading of items.

6. A system, comprising:

a sortation wall having an item-aggregation side and a packaging-processing side;

a loading apparatus incorporated into the sortation wall and comprising:

a chute passageway including a chute surface positioned extending along at least a portion of a distance between an inlet opening along the item-aggregation side and an outlet opening along the packaging-processing side, the chute passageway configured to operate in (a) an occupied state in which a receptacle is present in the chute passageway with a base wall of the receptacle received along the chute surface, and (b) an unoccupied state in which the receptacle is not present in the chute passageway;

a gate moveable between a closed position obstructing passage of the receptacle through the outlet opening and an open position permitting passage of the receptacle through the outlet opening; and a splitter mechanically coupled with the gate by a linkage configured to, with the chute passageway in the occupied state, (i) convert movement of the gate toward the closed position into movement of the splitter toward an away position, wherein during movement of the splitter toward the away position the splitter is configured to engage the receptacle so as to split a traveling wall of the receptacle away from the base wall and shift the receptacle from a collapsed configuration to an expanded configuration suitable for loading of items, and (ii) convert movement of the gate toward the open position into movement of the splitter toward a home position in which the splitter is arranged to be disengaged from the receptacle to facilitate introduction of the receptacle into the chute passageway prior to loading with items and/or removal of the receptacle from the chute passageway after loading with items.

7. The system of claim 6, further comprising the receptacle.

8. The system of claim 6, further comprising a cradle coupled with the sortation wall and sized to hold the receptacle to facilitate closure or other operations relative to the receptacle in the expanded configuration with items therein following removal of the receptacle from the outlet opening.

9. The system of claim 6, further comprising a retainer moveable between an engaged position and a released position, the retainer in the engaged position resisting movement of the base wall of the receptacle away from the chute surface, the retainer in the released position permitting movement of the receptacle away from the chute surface.

10. The system of claim 9, wherein the splitter in the home position is arranged to maintain the retainer in the released position, and wherein the splitter in the away position is arranged to permit the retainer to be in the engaged position.

11. The system of claim 10, wherein the retainer includes a groove in a pivoting plate, wherein the splitter includes or is coupled with a crossbar, and wherein the splitter in the home position maintains the retainer in the released position by the crossbar engaging the groove.

12. The system of claim 6, further comprising:

an item-aggregation station configured as a first operating environment for a first operator; and a packaging-processing station configured as a second operating environment for a second operator to work with the receptacle;

wherein the receptacle is a paper bag having the base wall and the traveling wall joined by collapsible walls; and wherein the sortation wall is arranged between the item-aggregation station and the packaging-processing station.

13. A system comprising a loading apparatus, the loading apparatus comprising:

a chute passageway including a chute surface positioned extending along at least a portion of a distance between an inlet opening of the chute passageway and an outlet opening of the chute passageway;

a gate moveable between a closed position obstructing passage through the outlet opening and an open position permitting passage through the outlet opening; and a splitter mechanically coupled with the gate by a linkage configured to convert movement of the gate toward the closed position into movement of the splitter toward an away position so as to split a traveling wall of a receptacle away from a base wall of the receptacle when the receptacle is received with the base wall along the chute surface.

14. The system of claim 13, wherein the linkage is further configured to convert movement of the gate toward the open position into movement of the splitter toward a home position in which the splitter is arranged to be disengaged from the receptacle.

15. The system of claim 13, further comprising the receptacle.

16. The system of claim 13, wherein the chute surface is arranged at a decline from the inlet opening toward the outlet opening.

17. The system of claim 13, further comprising a retainer arranged to secure the base wall of the receptacle when the receptacle is received with the base wall along the chute surface.

18. The system of claim 13, further comprising:

a sortation wall having an item-aggregation side and a packaging-processing side;

wherein the loading apparatus is incorporated into the sortation wall.

19. The system of claim 18, further comprising:

an item-aggregation station configured as a first operating environment for a first operator; and a packaging-processing station configured as a second operating environment for a second operator to work with the receptacle;

wherein the receptacle is a paper bag having the base wall and the traveling wall joined by collapsible walls; and wherein the sortation wall is arranged between the item-aggregation station and the packaging-processing station.

20. The system of claim 13, wherein the system is configured for operations relative to the receptacle, wherein the operations comprise:

undergo receipt of the receptacle into the chute passageway through the gate in the open position;

undergo engagement of the base wall of the receptacle with a retainer moved into an engaged position as a result of movement of the gate from the open position toward the closed position;

undergo splitting of the traveling wall from the base wall of the receptacle to shift the receptacle from a collapsed configuration to an expanded configuration due to the splitter moving the traveling wall as a result of movement of the gate from the open position toward the closed position;

undergo receiving of items into the receptacle in the expanded configuration in the chute passageway;

undergo maintaining of the expanded configuration of the receptacle at least in part by the items received within the receptacle;

undergo retraction of the splitter from the traveling wall of the receptacle in the expanded configuration as a result of movement of the gate from the closed position toward the open position;

undergo disengagement of the base wall of the receptacle due to the retainer being moved into a released position as a result of movement of the gate from the closed position toward the open position;

undergo relocation of the receptacle to a cradle;

undergo re-positioning or recognition of items within the receptacle at the cradle;

undergo closure of the receptacle; and undergo output of the receptacle via a takeaway conveyance.

* * * * *